United States Patent [19]

Gauger

[11] Patent Number: 4,870,883

[45] Date of Patent: Oct. 3, 1989

[54] TUNING DEVICE FOR RIMLESS DRUMS

[76] Inventor: Gary L. Gauger, 15108 Highland La., Minnetonka, Minn. 55343

[21] Appl. No.: 947,934

[22] Filed: Jan. 12, 1987

[51] Int. Cl.[4] ..... G10D 13/02

[52] U.S. Cl. ..... 84/413; 84/411 R; 84/414

[58] Field of Search ..... 84/411–421

[56] References Cited

U.S. PATENT DOCUMENTS

| | | | |
|---|---|---|---|
| 769,527 | 9/1904 | Bahr | 84/411 A |
| 2,061,244 | 11/1936 | Au-Miller | 84/411 A |
| 2,331,096 | 10/1943 | Strupe | 84/411 R |
| 3,186,289 | 6/1965 | Kester | 84/411 R |
| 3,481,239 | 12/1969 | Blumenfeld | 84/418 |
| 3,780,613 | 12/1973 | Ludwig | 84/421 |
| 4,079,657 | 3/1978 | Sobreira | 84/411 R |
| 4,520,709 | 6/1985 | Kester | 84/415 |
| 4,549,462 | 10/1985 | Hartry et al. | 84/413 |

FOREIGN PATENT DOCUMENTS

| | | | |
|---|---|---|---|
| 589617 | 6/1947 | United Kingdom | 84/411 A |
| 592979 | 10/1947 | United Kingdom | 84/411 A |

*Primary Examiner*—Lawrence R. Franklin
*Attorney, Agent, or Firm*—Moore & Hansen

[57] ABSTRACT

A tunable shell-less, rimless drum utilizes a multiplicity of tuning assemblies positioned about the frame of a pretensioned or untensioned standard drum head. Each tuning assembly engages the frame and avoids tone impairing deformation of the drum membrane during tuning so as to preserve the natural tonal quality of the drum. A pivotably mounted lever at the bottom of the tuning assembly bears against a tuning band which engages the drum membrane, and cooperating notches on tuning band and lever retain the tuning band in a fixed position relative to the frame to prevent pitch variation or binding due to tuning band movement. A threaded rod slides along a slot in the assembly and threadably engages a lock nut positioned within a nut confinement slot to prevent unwanted loosening of the rod. The invention provides a tunable, compact, lightweight, rimless drum which has tuning convenience and tonal quality superior to most large, heavy shell type drums.

35 Claims, 2 Drawing Sheets

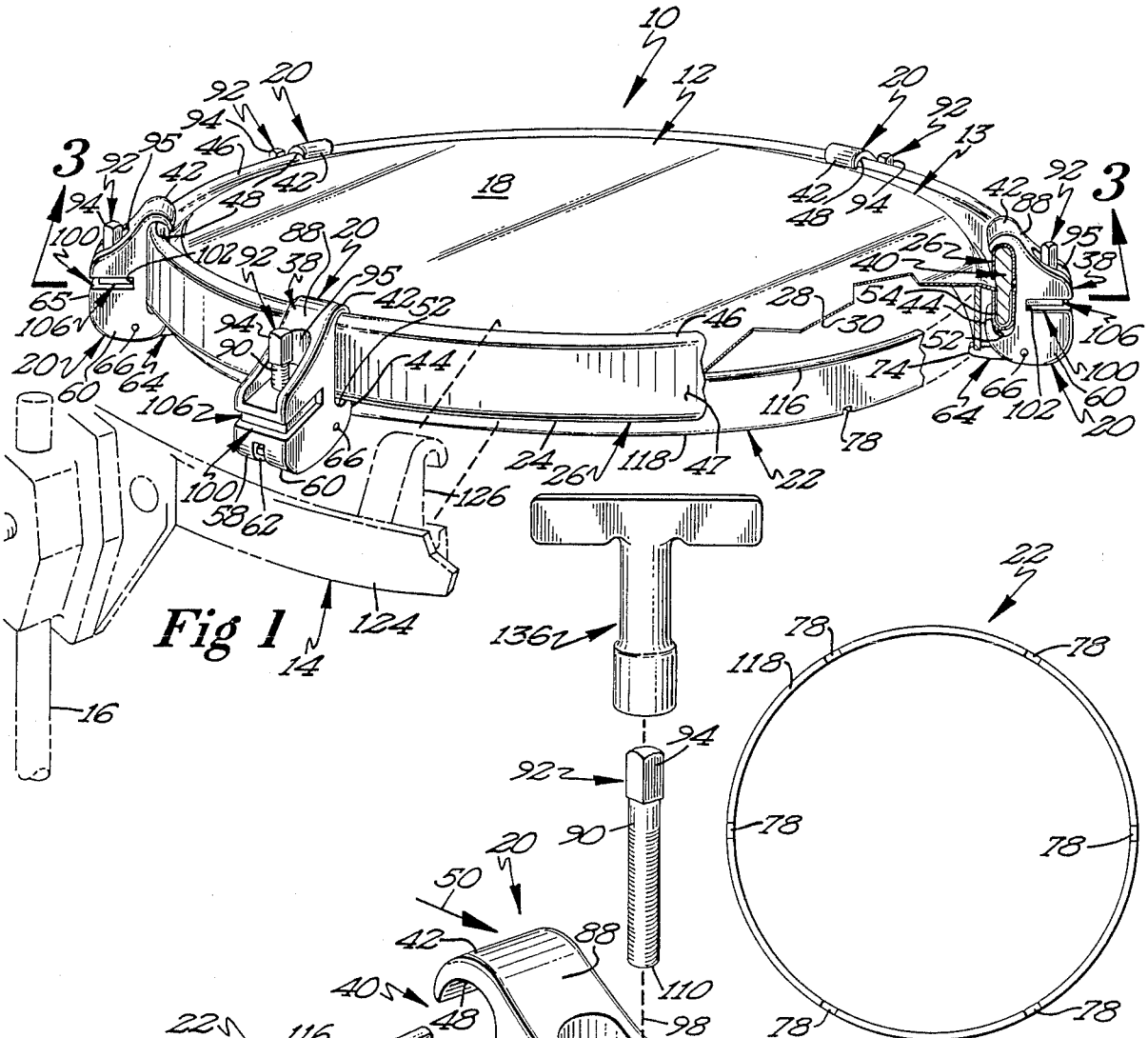
Fig 1
Fig 7
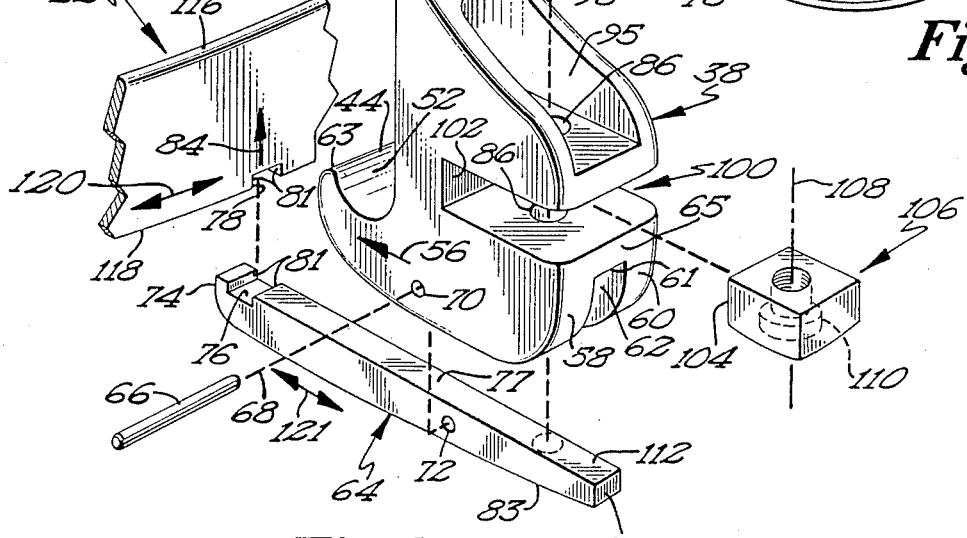
Fig 2

TUNING DEVICE FOR RIMLESS DRUMS

BACKGROUND OF THE INVENTION

The invention relates to the field of tunable rimless shell-less drums and comprises a lightweight, compact, rimless drum which is easily, conveniently tuned from above without distorting its frame in a way which reduces its tonal quality. The invention permits the making of a truly compact, lightweight, tunable, rimless drum with both convenient, reliable tuning and tone quality so high as to be superior to most traditional shell drums.

Rimless o shell-less drums are drums which can generate their sound with only a drum head and do not use a rim or shell to tune the head. The drum head consists of a membrane and a light frame which is attached to the membrane by adhesives or by mechanically crimping the membrane between two or more hoops which collectively make up the frame. The drum head may be wholly untensioned, or it may be slightly or wholly pretensioned during manufacture to have a defined pitch. Rimless or shell-less drums are dramatically lighter in weight and smaller in size than shell drums, but until the present invention could not match the tonal quality of shell drums and lacked a commercially accepted tuning system.

Traditional shell drums have a cylindrical shell with a membrane, or "batter head", stretched over one or both open ends of the shell. The membrane is retained by a hoop which extends over and about the end of the shell. A counterhoop rests atop the hoop, and this counterhoop is engaged by tension rods which are positioned around the counterhoop and threaded into lugs which are fixed to the outside of the shell. By tightening the tension rods with a small drum key, the hoop and counterhoop, which collectively comprise a frame, are pulled down onto the shell and the membrane is stretched over he edge of the shell until the pitch rises to the desired level. These tension rods have drum key engaging heads positioned around the frame, and confront the seated drummer so as to be fully accessible and visible to him. This traditional tuning system is considered wholly acceptable to drummers as being fast and convenient. Beside the traditional tension rod tuning devices, various modifications and variations have been developed for shell-type drums, some of which are shown in U.S. Pat. Nos. 4,475,434, 3,635,119, 4,218,952, 4,211,144, 4,295,405, 4,122,749 3,279,299, 3,029,679, 3,433,115, 2,433,200, 2,115,741, 4,079,657, and 3,981,220. U.S. Pat. No. 3,482,479 shows a tuning device used with the drum head of a tambourine but accessible only from below and within the tambourine shell.

Traditional shell drums are capable of excellent sound but are heavy, awkward to transport and cumbersome to store. A large shell drum set used in typical orchestral or rock bands can fill the storage capacity of an automobile and require multiple trips between car and stage to set up the instruments. The carrying of shell drums by marching bands can tire even the strongest drummers and limit the mobility and formations available to an otherwise more mobile marching unit.

Recognizing the weight and mobility problems of shell drums, Ralph C. Kester, Jr., in U.S. Pat. No. 3,186,289, issued June 1, 1965, disclosed a more compact, somewhat lighter weight drum for marching bands which utilized a wide rim as a shell substitute. The drum carried a membrane and tuning devices on the inside of the rim. This Kester drum was more mobile than shell drums, but the oversize rim, to be sufficiently rigid for tuning purposes, was still quite heavy, the drum was expensive, and the tuning devices were not easily accessible or convenient to actuate. While the Kester device represented a positive step toward size reduction, these drawbacks severely limited wide commercial acceptance of his drum.

In 1985, Kester, in U.S. Pat. No. 4,520,709, disclosed a lighter weight drum which had a further improved tuning system. In this drum, the tuning devices were placed outside the drum rim so they could now be seen by the seated drummer, but tuning was still awkward and done from below the drum by pushing the drum key upward against tension rods around the rim and then turning the key to force a tuning band against the membrane. During tuning, the key could easily slip off the rods and fall to the floor. Tuning was awkward, slow and hard to accomplish during performances.

Beside being awkward, the Kester tuning structure could deform the drum head frame when it was tightened, and resulting binding or twisting deformation could reduce tonal quality. The tuning device utilized a bracket with a notched portion which grabbed the outer edge of the drum head's frame, and when the bracket was pulled down during tuning to stretch the membrane, the frame could be distorted downwardly and twisted radially inwardly. Deforming the natural circular configuration of the frame always affects the way the drum vibrates and reduces its tonal quality. When the Kester tensioning rod was tightened in the bracket, it could also cause camming or binding between the rod and the unthreaded aperture through which the rod passes, resulting in the Kester hook 30 twisting clockwise and pulling away from the drum's center, thereby allowing the drum frame to be stretched into noncircular configurations and diminishing tonal quality. All such deformation affects the way a drum vibrates and changes its tonal qualities. The complex pillared frame of the Kester structure, while suitable for light drumming, was not designed to withstand heavy, rock drumming, which with its excessive vibration can loosen and rearrange components. The unusual design of the Kester drum also results in its membrane being wholly exposed to damage at the edges, and any striking in that region would cut the membrane. It could not be used for any rimshot type techniques. While lighter in weight, this second Kester drum design, with its complex frame, awkward tuning, exposed membrane and complicated assembly problems did not receive wide commercial acceptance.

Any camming or distorting of the tuning devices, twisting or binding of frame or tuning ring, or movement of the tuning band within the frame can introduce deformation which significantly reduces the drum's natural, rich, full tones. Excessive vibration during heavy, rock-style drumming can produce substantial movement between drum elements, and such unwanted movement must be restricted if full tonal response and consistent pitch are to be obtained with a shell-less or rimless drum. Handling such heavy vibration is also challenging with marching band drums where it is normal practice to tightly tune the drum heads for higher frequencies which seem louder and project more effectively in the large stadium, noisy crowd situations in which marching bands perform. Obtaining the high pitch requires excessive tightening of tuning apparatuses and significantly increases the pressure applied to the drum head and the tuning device. When heavy drumming is done on excessively tensioned heads, the vibration is even more likely to cause shifting, rearrangement, and deformation of the tuning elements, and introduce unwanted binding and overtone suppression.

As illustrated by the Kester patents, drummers have sought a compact, lightweight, easily transportable but finely tunable, high tonal quality drum, but have found it difficult to obtain both easily tunable, high quality sound and a compact, lightweight form. When the drum shell or rim is eliminated from the drum, the tuning must be done in a way that does not require a shell or rim. Until the present invention, no rimless or shell-less drum was tunable without twisting, distorting or binding the frame of the drum head or introducing other problems. Any such deformation reduced the desired depth and richness of tone which up to the present invention could be obtained only with traditional shell drums.

A further step in reducing drum weight occurred with U.S. Pat. No. 4,356,756 to Hartry et al which disclosed a new nontunable but low cost drum head which is known as a pretuned system head or PTS head. The PTS head features a membrane retained by a rigid but small, lightweight frame, with the membrane being tensioned chemically within the frame to provide a single tuned pitch level. The PTS head provided a lightweight, extremely compact playing surface, but its pitch could not be predicted until manufacture of the head was completed.

The PTS head was made using a chemical and heating process which tensioned the membrane during curing to give it a pitch. Each head had to be individually tested after manufacture to determine its pitch, and the pitch continued to change throughout a sixty to ninety day curing period, making the final pitch difficult to predict. The heads had to be classified as low, medium or high pitch range, but wide variations still existed within the ranges.

To speed up the production of PTS heads, a mechanical technique was developed in which the membrane head was mechanically crimped in its frame to thereby create a tensioning of the membrane. This process, described in U.S. Pat. No. 4,549,462 to Donald R. Hartry made the pitch of the PTS immediately ascertainable. This crimping process still resulted in heads which had a wide variation in pitch, and predictability of the pitch was virtually impossible. The need to test heads to classify them as low, medium or high continued, and there was still wide pitch variation in each range. Predictability was further complicated by the discovery that the pitch of the PTS heads was heavily dependent on ambient humidity changes and slightly dependent on changes in ambient temperature. These PTS heads were used as a substitute for standard untuned heads on traditional drum shells and provided a means to market a low cost drum set that required no tuning and appealed primarily to beginning drummers. As a result of all these problems, many drummers, seeking specific, consistent and controllable drum pitch, would not accept the untunable PTS heads.

With the introduction of the resonance isolation mounting system shown in U.S. Pat. No. 4,596,176, it became possible to mount the PTS head without deforming its frame or significantly damping out its tonal quality. The combining of the resonance isolation mounting system with the PTS head improved the sound quality and market appeal of the head significantly and made it highly attractive where mobility was needed. While the tone quality of the PTS head was much improved by the resonance isolation mounting, the pitch of each PTS head remained unpredictable, varied with temperature and humidity, still required individual testing and classification and could not be tuned by drummers.

Of the many drum tuning systems used over the years, the commercially successful ones are the ones that tune from above, are directly accessible, physically and visibly, to the drummer without any bending, kneeling or disassembly. Such access is crucial for fast, convenient tuning during performances. Musicians insist that a tuning system be simple to install, maintain and operate, be absolutely reliable, aesthetically attractive and inexpensive. The tuning system must be capable of holding its tune under even heavy, punishing rock concert conditions. It should have a minimum of parts which are not easily detached or lost, since it may be difficult or impossible to replace parts in time for a critical performance or to quickly obtain replacement parts from out-of-town suppliers. Until the present invention, no satisfactory tuning system had been found for shell-less, rimless drums or PTS heads, and so the weight and size advantages of rimless drums could not be utilized without the sacrifice of tone quality and tunability. For decades, these seemingly opposing requirements have been impossible to satisfy, and the art is a history of compromise and tradeoff between sound quality, bulk, weight, complexity, tuning convenience, cost and other characteristics. The present invention supplies a solution to these problems.

SUMMARY OF THE INVENTION

The invention comprises a tunable, rimless or shell-less drum which is lighter and more compact than presently known tunable drums and which has tonal quality exceeding most traditional shell drums. The invention uses either PTS drum heads or conventional, untensioned heads and permits an entire drum set to be stored and transported in a case no larger than that associated with a bass drum and effectively meets the long recognized need for a high tone quality, tunable drum with minimal bulk and weight.

The tuning device utilizes a group of tuning assemblies positioned at equal intervals around the drum frame. A tuning band is positioned below, within and concentric with the frame of the drum head and against the drum membrane. Each tuning assembly has a cradle which retains the drum frame at its upper and lower edges in a way which avoids irregular stretching of the drum head membrane and prevents the frame from undergoing tone impairing deformation, such as the binding, twisting, and distortion caused by many prior art tuning devices.

Positioned at the bottom of each tuning assembly is a pivotably mounted lever which has a front end which swings directly upward against the tuning band. Both the front end of the lever and the tuning band have cooperating, interlocking notches which, when engaged, prevent lateral or radial movement of the tuning band and retain it in a predetermined concentric position on the membrane, under even the heaviest drumming and vibrational conditions.

A threaded rod passes downwardly through a socket in the tuning assembly and contacts the rear end of the lever to pivot the lever about its axis and move the front end directly against the tuning band. The threaded rod is provided with a drum key engaging head which directly confronts the drummer so as to have optimum access and visibility. All tuning operations can be done from above the drum while the drummer is seated in normal playing position.

To assure that no loosening of the threaded rods occur during operation, a locking nut is positioned in a slot along the path of the threaded rod and securely retains the rod during operation.

When the tuning assemblies are hooked onto the drum frame and the tuning band inserted in the notches of the levers, an anti-loss feature makes it impossible to remove the tuning assemblies from the frame. When the tuning assemblies are slid about the drum frame with the tuning band in place, neither the band nor the assemblies can be removed from the frame even when levers are untightened. This configuration assures that tuning device components, even if untightened, are not lost.

The tuned drum is attached to a stand by a resonance isolation mounting system which supports the drum frame without deforming the frame or damping out desired resonance and overtones.

Because, the tuning assemblies avoid tone impairing deformation the drum frame and prevent any unwanted movement of the tuning band even under heavy drumming, no substantial drum membrane distortion or binding occurs and a new level of tonal quality is obtained from the rimless drum.

The pitch of the drum can be easily varied by tightening the threaded rods of the tuning assemblies, all such tuning and adjusting being done from above, with maximum visibility and convenience to the drummer. With the new tuning device, a lightweight, compact, up to now untunable PTS drum head can be used, and any pitch within the drum range obtained, with tuning being as easy and convenient as with traditional shell drums.

For the first time, the invention permits the making of a truly lightweight, highly compact drum set which is easily carried, stored and maintained but which has tonal characteristics and richness of sound exceeding those associated with shell-type drums. The mechanical design permits the use of lighter weight metal or plastic materials so as to obtain further weight savings and is easy and economical to manufacture.

These and other objects and advantages of the invention will appear more fully from the following description made in conjunction with the accompanying drawings wherein like reference characters refer to the same or similar parts throughout the several views.

BRIEF DESCRIPTION OF THE DRAWINGS

FIG. 1 is a perspective view of a tunable, rimless drum embodying the invention, with the elements being partly cutaway, exploded and in phantom.

FIG. 2 is a perspective, exploded view of a tuning assembly used with the embodiment of FIG. 1.

FIG. 7 is a bottom view of a tuning band usable with the invention.

DESCRIPTION OF THE PREFERRED EMBODIMENTS

Figures 3, 4, 5, 6:
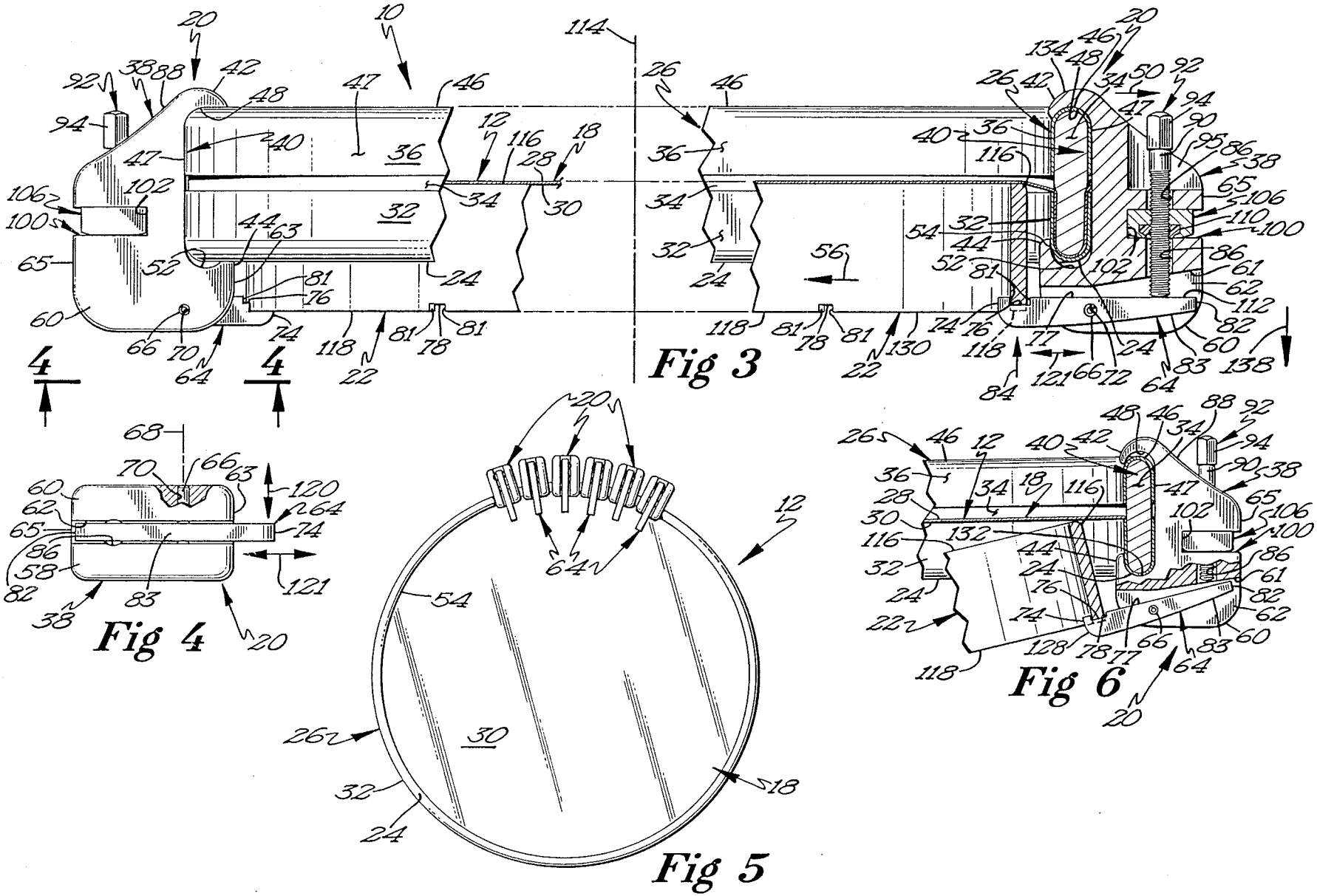
FIG. 3 is a cross sectional side elevation view of the tunable, rimless drum of FIG. 1 taken in the direction of cutting plane 3—3.
FIG. 4 is a bottom view of a tuning assembly taken in the direction of arrows 4—4 of FIG. 3 and partially cut away.
FIG. 5 is a bottom view of a drum head showing a group of tuning assemblies mounted on the frame and illustrating an intermediate step in attaching the tuning assemblies to the drum head.
FIG. 6 is a partial cross sectional side elevation view of a drum head and tuning assembly to illustrate a further step in attaching the tuning band.

Referring now to FIGS. 1 and 3, a tunable, rimless drum 10 embodying the invention has a drum head 12 which is supported by a drum mounting device such as resonance isolation drum mounting system 14 attached to a stand 16 by any suitable means known to the art. The drum head 12 includes a generally annular outer supporting frame 26 which is rigidly fixed to and encompasses the outer periphery 13 of the drum head membrane 18 with the membrane having its intersection with the frame medial, and preferably centered, between upper and lower edges 46 and 24 of the frame. The membrane 18 has an obverse or batter face 28 and a reverse face 30, which lie substantially in a plane, and typically the membrane 18 is fixed to the frame 26 by an appropriate adhesive or by mechanical crimping.

A multiplicity of tuning assemblies 20 are positioned around the outer periphery of the drum head 12, and each assembly engages a circular tuning band 22, urging it against the reverse face 30 of the membrane 18.

The present invention is intended for use with either conventional rimless, non-tensioned drum heads or with the more recently developed pre-tuned rimless heads commercially known as PTS heads of the type shown in U.S. Pat. Nos. 4,416,181, 4,356,756 and 4,549,462 to Donald R. Hartry et al. When used with either a wholly untensioned head or with a pre-tuned head, the invention enables the rimless drum head to be brought to any desirable pitch within the range of the head. It should be understood that the rimless drum heads for which the present invention is designed are those which do not utilize any rim or shell for tuning of the head, and which typically consist of merely a membrane 18 and an encompassing frame 26. Typically, such a rimless head has the membrane 18 retained within a hoop 32 by an adhesive interposed between the segment 32 and the reverse face 30. A wedge 34 may be in the hoop 32, locking the membrane 18 between the wedge and the hoop 32. A counterhoop 36 is then applied to the top of the wedge 34. Mechanical crimping may be utilized to interlock the hoop 32 and counterhoop 36 with wedge 34 and adhesives are applied to one or both sides of the membrane where they join the frame 26. While a specific form of head 12 is shown herein as being usable with the invention, it should be understood that any rimless head having a membrane and an encompassing frame, and whether or not pre-tuned to some level, is usable with the invention and is within its purview.

When the tuning device is used with a standard, untensioned drum head of the type used on a standard shell drum, it is necessary to use a counterhoop placed around the edge of the head so as to protect the edge of the membrane from drumstick damage and provide an edge onto which the upper fingers 42 of the tuning assemblies 20 can be clipped.

With the embodiment 10 shown in FIGS. 1–5, six identical tuning assemblies 20 are positioned about the frame 26, and as best shown in FIG. 2, each tuning assembly 20 includes a sturdy, substantially rigid, frame engaging yoke member or housing 38 which is preferably cast or stamped from an appropriate steel or metal alloy. The yoke member 38 has a cradle 40 which is constructed and arranged to closely receive the cross section of frame 26 therein and to closely confine the frame. The cradle has an upper frame-engaging finger 42 and a cooperating lower frame engaging finger 44 which respectively engage and retain the upper edge 46 and the lower edge 24 of the frame 26. The upper finger 42 of the cradle 40 serves as a drum frame retention means, and the upper finger 42 and lower finger 44 cooperate to provide a means for preventing tone impairing deformation of the frame 26 at its intersection with the membrane 18 by closely encompassing and confining the upper and lower edges of the drum frame cross section to prevent any substantial tone impairing irregular stretching of the drum membrane 18, as described below. As best shown in FIG. 3, concave cradle surface 48 of upper finger 42 closely engages the upper edge 46 and outer edge 47 of the frame. Similarly, the lower finger 44 has a concave cradle surface 52 (FIG. 2) which closely engages the lower portion of inner edge 54 of the drum frame. By engaging the upper and lower edges 46 and 24, respectively, of the frame, any twisting forces which might be generated and applied to the frame during tuning are transferred to the frame by the assembly at the upper and lower edges 46 and 24, resulting in the frame pivoting slightly about the frame's intersection with the membrane 18, with twisting of the intersection itself being inhibited and undergoing no substantial twisting. With the intersection being subjected to no substantial twisting, any irregular stretching of the membrane is avoided and tone impairing deformation of the membrane does not occur.

As best shown in FIG. 2, the lower portion of yoke member 38 includes first and second bifurcations 58 and 60, respectively, which are separated by a straight channel 62 which extends from the front 63 to the rear 65 of the yoke member and angles upward as it passes the cradle 40.

Positioned within the channel 62 is an elongated rigid lever 64 which is pivotably mounted on a pin 66 which is inserted along the lever axis 68 of transverse bore 70, which extends through bifurcations 58 and 60, with the pin 66 passing through an aligned aperture 72 in lever 64. A first or front end 74 of lever 64 has a notch 76 in upper edge 77 which, during operation, interlocks with one of the notches 78 in tuning band 22 as further described hereafter. Front end 74 of the lever joins gently curved bottom edge 83, which terminates at rear or second end 82 of the lever. The edge 83 is curved to facilitate easy handling and to avoid damage to adjacent, nested drum heads in the event heads are stacked or nested during storage and transport. The front end 74 of the lever extends forwardly and beyond front surface 63 of the yoke member so as to firmly engage the tuning band 22 and urge the band directly upward in a direction substantially perpendicular to membrane 18 and parallel to tuning band axis 114.

As best shown in FIGS. 2–4, a socket 86 extends from the upper surface 88 downwardly to intersect and communicate with the roof 61 of channel 62. The socket 86 has a central axis 98 and is of a diameter greater than the greatest thickness of the shaft 90 of threaded rod 92, permitting the shaft 90 to slide freely in the socket 86. The socket has a recess 95 surrounding the upper end of the socket so that when the rod head 94 is below the level of upper surface 88, a standard drum key 136 can be received on the head.

Positioned along the axis 98 of socket 86 is a nut confinement slot 100 which has a rear wall 102 which bears firmly against a side 104 of lock nut 106, when the nut is in slot 100 with the nut axis 108 coinciding with socket axis 98. By such positioning, the side 104 which is in close engagement with rear wall 102, is prevented from rotating about axis 108 when the threads of rod 92 are engaged with the nut 106. The slot 100 and nut 106 provide a rod retention means to allow the rod to be threaded toward the lever 64 as needed. As best shown in FIG. 3, the rod 92 is threaded into and through lock nut 106 with the threads of the rod passing through and engaging an internal friction lock washer insert 110, which serves as a locking means to prevent unwanted slippage or rotation of the rod during heavy drum vibration. The rod 92 is threaded through the nut 106 until its lower end contacts the upper edge 112 of lever 64. By additional advancement of the rod 92 toward rear end 82 of lever 64, the lever's front end 74 is urged upwardly against notch 78 of the tuning band 22.

The rod 92 is preferably formed from a shortened, commercially available drum tension rod of the type found on most shell drums.

The tuning band 22 is generally circular and is formed with a rounded upper bearing edge 116 to assure a smooth contact surface with membrane 18. Spaced around the periphery of the band's lower edge 118 are a multiplicity of tuning band notches 78, here shown as six such notches, all equally spaced.

The tuning band 22 is formed of a generally rigid material such as metal or plastic and has a diameter slightly smaller than the internal diameter of the drum frame 26. The tuning band is substantially concentric with the frame 26 of the drum. The notches 78 in the tuning band are positioned to closely confront the corresponding notches 76 of the levers 64 of each tuning assembly, and when the tuning assemblies are in operating position and engaging the drum frame 26, the levers are forced upwardly to cause the notches 76 and 78 to interlock. This interlocking action of vertical abutments 81 at the sides of each notch 76 and 78 assures that the tuning band stays substantially concentric within the drum frame and, as shown in FIG. 2, prevents unwanted movement of the tuning band in radial directions 121 and lateral or tangential directions 120 under the heaviest of drumming conditions.

As best shown in FIG. 3, when notch 76 of lever 64 is urged upward in direction 84 and contacts the tuning band 22, the upper edge 77 of the lever is generally parallel to the plane of the membrane 18, and the force applied by the lever against the tuning band 22 is substantially perpendicular to the plane of the membrane and parallel to axis 114. By applying this force parallel to the tuning band axis and at a multiplicity of equally spaced locations 78, the tuning band does not tend to bend, distort, or twist from its generally circular configuration, and all the forces applied by the tuning assemblies 20 move the tuning band directly perpendicularly against the membrane 18. Because of the perpendicularly directed force, the interlocking notches 76 and 78, and the resulting absence of significant binding, distortion, or twisting, the tuning band 80 can be less massive than was formerly the case, shorter from top to bottom, and can also be thinner from inside to outside, thereby significantly reducing the weight of the band 22. In addition, because of the interaction of the interlocking notches and the perpendicularly directed forces, the material for the tuning band need no longer be formed of a steel or steel alloy and can, instead, be formed of lighter materials such as aluminum or an appropriate plastic.

It should be understood that the number of tuning assemblies positioned about the frame of the drum will vary with the size of the drum. It has been found that at least four tuning assemblies should be used to obtain acceptable results, although six or more assemblies are preferred and produce more uniform pressure between tuning band and membrane and less deforming of the frame. For drum heads having ten, twelve, or fourteen inch diameters, six tuning assemblies 20 provide excellent results. For drums heads having sixteen or twenty inch diameters, six to eight assemblies are needed, and eight are preferred.

While the tuning device has been shown as usable on a circular drum head, it should be understood that other drum head configurations such as oval, triangular, square and the like may also be tuned using the invention. In such situations, the tuning band should have a configuration like that of the drum frame, as for example a triangular tuning band for a triangular drum. Tuning assemblies should be positioned at equal intervals around the band and in some cases at corners of the band.

It is desirable that the tunable, rimless drum 10 be mounted to stand 16 in a manner which does not damp out or attenuate the natural frequencies and tonal quality of the instrument. This goal can be achieved by supporting the drum head 12 with a resonance isolation mounting system 14 of the type shown in U.S. Pat. No. 4,596,176. Such a mounting system utilizes an arcuate member 124 to which are mounted a plurality of flexible, rubber, frame supporting fingers 126, which engage the frame 26 of the drum head 12 in a vibration isolating manner which does not attenuate the natural tones. When the resonance isolation mounting system 14 is interposed between the frame 26 and stand 16, frame deformation is avoided and the full tonal qualities of the drum 10 come through to the listener.

OPERATION OF THE INVENTION

In operation, the drummer first adjusts the tuning assemblies 20 so the levers 64 will have their front ends 74 inclined downwardly to a lever position 128 (FIG. 6). He next attaches an appropriate number of the tuning assemblies 20 onto the frame 26 of the drum head 12 by first hooking the concave surface 52 of the lower finger 44 of each assembly onto the lower edge 24 of the frame and then, with bottom 24 bearing against the finger surface 52 (FIG. 6), swinging the closely fitting upper finger 42 over and onto the upper edge 46 of the frame. These steps place the frame in cradle 40 with a gap between upper finger surface 48 and upper edge 46. During the initial steps just described, the tuning band 22 is not yet installed, and all of the tuning assemblies are next slid along the frame 26 so they are closely grouped as shown in FIG. 5. With the assemblies thus grouped and with their levers in positions 128, the tuning band 22 is next positioned within the drum head 12 by slipping its bottom 118 within the notches 76 of the levers of all of the tuning assemblies, as shown in FIG. 6, and next swinging the tuning band toward membrane 18 to a position 130, shown in FIG. 3, with the band upper edge 116 in full contact with the reverse face 30 of the membrane. In this position 130, the lower edge 118 of the tuning band 22 forces the tuning assemblies to shift downward to position 134 (FIG. 3) Where the upper edge 46 of the frame 26 is in direct, full contact with surface 48 of finger 42. This movement creates a gap between the lower edge 24 of the frame and surface 52 of lower finger 44 (FIG. 3). So long as the tuning band is between the membrane 18 and levers 64, the cooperating fingers of the grouped tuning assemblies prevent the assemblies from being removed from the frame 26.

The operator next slides the individual tuning assemblies 20 to equally spaced positions around the frame 26 with the tuning assemblies being arranged so the lever 64 of each assembly underlies and confronts a tuning band notch 78 such that the individual notches 76 and 78 of each lever and tuning band, respectively, can engage and interlock. As soon as the tuning assemblies are moved from the grouped arrangement of FIG. 5 to an equally spaced position, the tuning band 22 can no longer be removed from within the drum head 12. As described above, the tuning band 22 cooperates with the assemblies and the frame to lock the assemblies in place on the frame, even if the levers are not tightly engaging the band. This anti-loss feature assures that the assemblies are not separated from the drum frame or lost during travel. This result is highly desirable because it assures that during use or transport of the drum, it is impossible to lose the tuning assemblies or tuning band, even if the assemblies or band are untightened. In order to remove the band 22 and the individual assemblies 20, the operator must reverse the installation procedure by moving all of the tuning assemblies back to the group position of FIG. 5 and then swing the band 22 outwardly and away from the reverse face 30 of the membrane 18.

When the tuning assemblies 20 have been positioned around the frame of the drum, with the notch 76 of each lever 64 confronting a notch 78 of the tuning band, the operator next tightens the threaded rod 92 by applying key 136 to the head 94 of each rod to rotate the threaded rods downward in socket 86 until the notch 76 of each individual lever 64 interlocks with the confronted notch 78 on the tuning band. When interlock occurs, all tuning assemblies are securely, tightly in place and can no longer slide in directions 120 along the frame 26. Tuning of the membrane 18 can now begin.

The operator now alternately tightens each threaded rod 92 a little at a time, tightening the rods of each successive assembly a substantially equal amount, until the desired drum pitch has been obtained. The tuning is easy because the operator has visual contact with each rod head 94 and with each tuning assembly while seated in a normal drumming position. All drum key adjustments to the assemblies are done from above the drum, thereby avoiding any bending or kneeling by the operator and eliminating the need to do any adjusting from beneath the drum head.

As the drummer turns the threaded rods 92 in a clockwise direction about the axis 98, each rod moves downwardly, turning freely in socket 86 but threadably advancing through the threaded lock nut 106 so that the rod end 110 pushes the rear end 112 of lever 64 downwardly in direction 138 to pivot it about pin 66. During rod rotation, lock nut 106 has its side 104 bearing against side 102 within slot 100 so as to prevent the nut 106 from turning and allowing rod rotation only when key 136 is used. As the end 82 of the lever is pushed downwardly, the front end 74 of the lever moves in direction 84 substantially parallel to the axis 114 of the tuning band 22, thereby engaging and urging the tuning band 80 directly against the membrane without twisting or distorting the band or creating any binding of the membrane or frame. As the band 22 is pressed against the membrane, the membrane is gradually stretched and tensioned and its pitch rises. Because during tuning each of the levers 64 has its upper edge 112 generally parallel to the membrane 18, the downward force of the threaded rod 92 results in a force being exerted in a direction 84 which is generally perpendicular to the plane defined by the lower edge 118 of the band 22.

The interlocking of notches 76 and 78 assures that each tuning assembly cannot slide in directions 120 along the tuning band because its lever 64 is closely constrained by the abutments 81 at each edge of the tuning band notch 78. Similarly, the interlocking of the notches 76 and 78 and presence of the abutments 81 on the lever notch 76 prevent the tuning band from moving radially in directions 121 toward or away from the frame 26 of the drum. This interlocking of the notches 76 and 78 assures that the tuning band 22 stays largely concentric with the frame 26 and that the tuning assemblies 20 stay in the intended positions where they are equally spaced around the band. Such constraint is desirable because if the band shifts to be nearer the frame at some point, the band may apply more leverage to the membrane at that point. This will stretch the membrane more than necessary at that point and also twist or deform the frame at that point. Such stretching or twisting would be detrimental to the drum's tonal quality.

The lock nut 106 and its locking insert 110 assure that when the tuning rod 92 has been tightened to a desired level, it does not loosen in nut 106, even under the heaviest drumming conditions.

The locking between the tuning assemblies 20 and the band 22, and the close engagement between each tuning assembly and the frame, provide a tight, rigid interlocking arrangement between band, tuning assemblies and the frame itself and prevent the intersection between frame and membrane from twisting, or being otherwise deformed from its natural configuration during tuning and operation. By thus preventing irregular stretching of the membrane during tuning and operation, the tonal quality of the drum is maintained at its highest level.

The tunable drum 10 may be equipped with an electronic trigger or detonator, if desired, so as to use the drum to trigger electrically simulated tones or special light or sound effects. Such a detonator is preferably a type which serves as a combined microphone and trigger so the acoustic tones of the drum may be picked up and amplified when desired.

While the preferred embodiment of the present invention has been described, it should be understood that various changes, adaptations and modifications may be made therein without departing from the spirit of the invention and the scope of the appended claims.

What is claimed is:

1. A drum head tuning device actuatable by a drummer and usable with a drum head having a membrane with obverse and reverse faces lying substantially within a plane, the membrane having a periphery fixed to and encompassed by a supporting frame having an inside, outside and upper and lower edges, the upper and lower edges being spaced upwardly from and downwardly, respectively, from the membrane, to permit controlled tuning of the drum head pitch, comprising:

a tuning band having a lower edge and a central axis and positionable within the frame and against the reverse face of the membrane;

a multiplicity of tuning assemblies engaging said tuning band, each said assembly including:

a frame engaging yoke member constructed and arranged to closely engage the upper edge and inside lower edge of the supporting frame;

force applying means movably connected with said yoke member and contacting said tuning band to selectively move said band relative to said assembly and toward the membrane to vary the pitch of the drum head; and said tuning assemblies cooperating with one another to force said tuning band against the reverse face of the membrane to thereby raise the pitch of the drum head in response to actuation of said force applying means by the drummer.

2. The drum head tuning device of claim 1 wherein:

said force applying means includes a lever pivotably mounted to said yoke member and having first and second ends, said first end contacting said tuning band and applying force to said band in a direction substantially parallel to said tuning band axis and adjacent the reverse face of the membrane in response to movement of said second end so as to permit a reduction in weight and rigidity of said tuning band; and said tuning band is constructed of a non-ferrous material having a density less than steel so as to reduce the weight of said band.

3. The drum head tuning device of claim 2 wherein:

each said yoke member includes upper and lower fingers wherein the shortest distance between said fingers is less than the distance between the upper and lower edges of the frame;

said yoke member further includes a cradle having upper and lower internal concave surfaces and wherein the longest distance between said surfaces exceeds said shortest distance between said upper and lower fingers such that the frame can have its lower edge slipped within said cradle to contact said lower internal concave surface of said cradle and still have the upper edge of the frame be movable past said upper finger to lie wholly within said cradle; and said tuning having a height such that when positioned between the membrane and said lever, said band forces said assembly downward relative to the frame to force said upper internal, concave surface of said cradle against the upper edge of the frame and position the lower edge of said frame for retention by said lower finger of said cradle to thereby prevent separation of the frame from said assembly when said band is between said lever and the membrane.

4. The drum head tuning device of claim 3 wherein said force applying means includes a threaded rod having a central rod axis and movably mounted to said yoke member and oriented generally parallel to said tuning band axis and accessible for actuation from above the plane of the membrane by the drummer so as to exert force against said second end of said lever by rotating said threaded rod about said rod axis to swing said first end of said lever against said tuning band.

5. The drum head tuning device of claim 1 wherein:

said force applying means includes a lever pivotably mounted to said yoke member for movement about a lever axis and having first and second ends, said first end contacting said tuning band to urge said band against the reverse face of the membrane in response to movement of said second end about said lever axis; and said tuning band has a multiplicity of notches equally spaced about said band with each said notch receiving a said first end of a said lever therein and confining said first end against lateral movement along said band.

6. The drum head tuning device of claim 5 wherein said first end of each said lever of each said assembly includes a notch for confining said tuning band therein, said notches of said levers and said notches of said band interlocking and cooperating to prevent deforming movement of said band during tuning and drum operation and to retain said band a predetermined distance from the frame.

7. The drum head tuning device of claim 1 wherein said yoke member includes first and second bifurcations with a channel between said bifurcations, and further includes a lever pivotably mounted within said channel and having first and second ends.

8. The drum head tuning device of claim 7 wherein said yoke member includes a socket having a central axis, said socket being positioned transverse to said channel and confronting said second end of said lever, and wherein said force applying means includes a threaded rod positioned within said socket for movement along said socket toward and away from said lever.

9. The drum head tuning device of claim 8 and further including a rod retention means positioned along said axis of said socket and engaging said threaded rod to retain said rod.

10. The drum head tuning device of claim 9 wherein said rod retention means includes locking means to prevent vibration induced rotation of said rod during drum operation.

11. The drum head tuning device of claim 8 wherein:

said yoke member includes a nut confinement slot for receiving a nut and preventing nut rotation; and said rod retention means includes a nut positioned within said nut confinement slot and on said axis of said socket to threadably receive said rod therein.

12. The drum head tuning device of claim 11 wherein said nut is a locking nut.

13. A tunable, rimless drum usable by a drummer to control pitch comprising:

a drum head including a supporting frame and a membrane, said membrane having an obverse batter face, a reverse face and an outer periphery, said frame being fixed to and encompassing said outer periphery of said membrane;

a tuning band having a central axis, said band positioned within said frame and against said reverse face of said membrane, said tuning band including a multiplicity of notches spaced along said band;

a multiplicity of tuning assemblies engaging said tuning band and said frame, each said assembly including:

a housing;

frame retention means on said housing to engage said frame;

force applying means on said housing contacting said tuning band and including a lever pivotably mounted to said housing and engaging and fitting within said notch of said tuning band to prevent lateral movement of said tuning band relative to said lever, thereby assuring minimal pitch variation after tuning of the drum; and said tuning assemblies cooperating with one another to force said tuning band toward said frame to thereby stretch said membrane between said band and said frame to selectively change the pitch of said drum head in response to actuation of said force applying means by the drummer.

14. A rimless drum tuning device actuatable by a drummer and usable with a rimless drum consisting of a head having a membrane with obverse and reverse faces lying substantially within a plane and a supporting frame fixed to and encompassing the membrane and having an inside, outside and upper and lower edges, to permit controlled tuning of the drum head pitch, comprising:

a tuning band having a lower edge and a central axis and positionable within the frame and against the reverse face of the membrane;

a multiplicity of tuning assemblies engaging said tuning band, each said assembly including:

a frame engaging yoke member constructed and arranged to closely restrain the upper edge and inside lower edge of the supporting frame against movement toward said central axis of said band and movement away from said central axis of said band, respectively;

force applying means movably connected with said yoke member and contacting said tuning band to selectively move said band relative to said assembly and toward the membrane to vary the pitch of the drum head; and said tuning assemblies cooperating with one another to force said tuning band against the reverse face of the membrane to thereby raise the pitch of the drum head in response to actuation of said force applying means by the drummer.

15. The drum head tuning device of claim 14 wherein:

said force applying means includes a lever pivotably mounted to said yoke member for movement about a lever axis and having first and second ends, said first end contacting said tuning band to urge said band against the reverse face of the membrane in response to movement of said second end about said lever axis; and said tuning band has a multiplicity of notches equally spaced about said band with each said notch receiving a said first end of a said lever therein and confining said first end against lateral movement along said band.

16. The drum head tuning device of claim 15 wherein said first end of each said lever of each said assembly includes a notch for confining said tuning band therein, said notches of said levers and said notches of said band interlocking and cooperating to prevent deforming movement of said band during tuning and drum operation and to retain said band a predetermined distance from the frame.

17. The drum head tuning device of claim 16 wherein said force applying means includes means for applying force directed parallel to said central axis of said tuning band and against said lower edge of said tuning band so as to avoid substantial lateral forces which would otherwise deform said tuning band.

18. The drum head tuning device of claim 14 wherein said multiplicity of assemblies comprises at least six assemblies.

19. A tunable, rimless drum usable on a stand by a drummer comprising:

a drum head including a supporting frame and a membrane lying substantially within a plane, said membrane having an obverse batter face, a reverse face and an outer periphery, said frame having upper and lower edges, an inside and outside, and being fixed to and encompassing said outer periphery of said membrane;

a tuning band having a central axis and positioned within said frame and against said reverse face of said membrane;

a multiplicity of tuning assemblies engaging said tuning band and said frame, each said assembly including:

frame retention means engaging and retaining said frame;

force applying means contacting said tuning band and including a threaded rod having a rod head at one end thereof, said rod head being positioned adjacent said outside of said frame and above said lower edge of said frame and rotatable by the drummer from above said plane of said membrane so as to permit the drummer to have both visual and direct physical access to said rod head for rapid and convenient tuning rotation of said rod head; and said tuning assemblies cooperating with one another to move said tuning band relative to said frame to thereby stretch said membrane between said band and said frame to change the pitch of said drum head in response to actuation of said force applying means by the drummer.

20. The tunable, rimless drum of claim 19 wherein:

said force applying means includes a lever pivotably mounted relative to said retention means and having first and second ends, said first end contacting said tuning band and applying force to said band in a direction substantially parallel to said tuning band axis and toward said reverse face of said membrane in response to movement of said second end of said lever, thereby substantially eliminating deformation of said band and thereby permitting a reduction in weight and rigidity of said tuning band; and said tuning band being constructed of a non-ferrous material having a density less than steel so as to reduce the weight of said band.

21. The tunable, rimless drum of claim 20 wherein each said threaded rod has a rod axis, has said rod axis oriented generally parallel to said tuning band axis and said rod is positioned to exert force against said second end of said lever as said threaded rod is advanced toward aid lever by the drummer.

22. The tunable, rimless drum of claim 21 wherein said tuning band has a multiplicity of notches equally spaced on said band with each said notch confronting and receiving a said first end of a said lever therein and confining said first end so as to prevent lateral movement of said band relative to said lever.

23. The tunable, rimless drum of claim 22 wherein said first end of said lever of said assembly includes a notch for confining said tuning band therein, said notch of said lever and said notch of said band interlocking and cooperating to prevent deforming movement of said band during tuning and operation and serving to space said frame and said band a predetermined distance apart.

24. The tunable, rimless drum of claim 23 wherein each said assembly includes first and second bifurcations, said lever being pivotably mounted to said bifurcations and swingable in a channel between said bifurcations.

25. The tunable, rimless drum of claim 24 wherein each said tuning assembly includes a socket having a central axis intersecting said channel and confronting said second end of said lever, said threaded rod extending within said socket.

26. The tunable, rimless drum of claim 25 and further including rod retention means positioned along said axis of said socket and engaging said threaded rod to retain said rod.

27. The tunable, rimless drum of claim 26 wherein said rod retention means includes locking means to prevent vibration induced rotation of said threaded rod during drum operation.

28. The tunable, rimless drum of claim 26 wherein:

each said assembly includes a nut confinement slot for receiving a nut and preventing nut rotation; and said rod retention means includes a nut positioned within said nut confinement slot and on said axis of said socket to threadably receive said threaded rod therein.

29. The tunable, rimless drum of claim 28 wherein said nut is a locking nut.

30. The tunable, rimless drum of claim 19 and further including a resonance isolation mounting system connected to said stand and capable of supporting the frame of the drum head at a multiplicity of locations, each location being positioned between a pair of said tuning assemblies.

31. The tunable, rimless drum of claim 19 wherein said upper and lower edges of said drum head frame are spaced vertically from said membrane with said membrane having an intersection with said frame medially between said upper and lower edges to thereby cause any twisting of said frame produced by said assemblies to be applied to said frame at said upper and lower edges distant from said intersection to thereby inhibit the application of frame twisting forces to said membrane as said tuning band moves toward said membrane during tuning.

32. The tunable, rimless drum of claim 31 wherein the intersection between said membrane and said frame is substantially centered between the upper and lower edges of said frame.

33. A tunable, rimless drum usable by a drummer to tune the drum pitch comprising:

a drum head including a supporting frame and a membrane said membrane having an obverse batter face, a reverse face and an outer periphery, and said frame being fixed to and encompassing said outer periphery of said membrane;

a tuning band having a central axis, said band positioned within said frame and against said reverse face of said membrane;

a multiplicity of tuning assemblies engaging said tuning band and said frame, each said assembly including:

a housing;

frame retention means on said housing to engage said frame;

force applying means on said housing contacting said tuning band and including a lever pivotably mounted to said housing and having a notch engaging and restraining said tuning band to prevent radial movement of said band toward or away from said tuning band axis to prevent movement of the tuning band due to excessive drumming vibration and thereby retain said band at a predetermined spacing from said frame and maintain a substantially unchanging force on said membrane so as to avoid unwanted pitch loss; and said tuning assemblies cooperating with one another to force said tuning band toward said frame to thereby stretch said membrane between said band and said frame to collectively change the pitch of said drum head in response to actuation of said force applying means by the drummer.

34. The tunable, rimless drum of claim 33 wherein: said tuning band includes a multiplicity of notches, a tuning band notch confronting and engaging the notch of each said lever to interlock said band and said levers to prevent lateral movement of band and tuning assemblies, thereby assuring minimal pitch variation after tuning of the drum.

35. The tunable, rimless drum of claim 33 wherein said tuning band is positioned substantially concentric with said frame.

* * * * *